United States Patent [19]

Hoffman

[11] Patent Number: 4,871,338

[45] Date of Patent: Oct. 3, 1989

[54] PERSONAL FLOATATION DEVICES

[76] Inventor: Richard S. Hoffman, 1175 NE. 125 St., North Miami, Fla. 33161

[21] Appl. No.: 267,354

[22] Filed: Nov. 4, 1988

[51] Int. Cl.[4] ..... B63C 9/10

[52] U.S. Cl. ..... 441/116; 441/108; 441/115

[58] Field of Search ..... 441/106, 108, 111, 112, 441/114–119, 122–124, 88

[56] References Cited

U.S. PATENT DOCUMENTS

| | | | |
|---|---|---|---|
| 1,050,693 | 1/1913 | Richardson | 441/116 |
| 1,182,841 | 5/1916 | Edmonds | 441/116 |
| 1,295,667 | 2/1919 | Ziman | 441/116 |
| 1,670,887 | 5/1928 | Gibson | 441/116 |
| 2,893,020 | 7/1959 | Miller | 441/123 |
| 3,181,183 | 5/1965 | Allen | 441/116 |
| 3,570,030 | 3/1971 | Baker | 441/116 |
| 3,733,631 | 5/1973 | Cohn | 441/116 |
| 4,655,718 | 4/1987 | Lucius | 441/116 |
| 4,668,202 | 5/1987 | Scheurer | 441/116 |

*Primary Examiner*—Joseph F. Peters, Jr.
*Assistant Examiner*—Clifford T. Bartz
*Attorney, Agent, or Firm*—Malloy & Malloy

[57] ABSTRACT

An improved personal floatation device composed of (a) a back panel to encircle the back and sides of a wearer, (b) a front panel and (c) a shoulder panel with a head opening which interconnects the front and back panel, and (d) straps for fastening the device about the body of a wearer and wherein the device includes a head support panel swingably connected to the top of the back panel for supporting the head of a wearer when worn by a user in water.

11 Claims, 3 Drawing Sheets

PERSONAL FLOATATION DEVICES

FIELD OF THE INVENTION

This invention relates to personal floatation devices.

BACKGROUND OF THE INVENTION

In the past there have been numerous types of floatation devices. This invention is of an improved personal floatation device. The device is adapted to be worn about the upper body of a wearer. It is intended to be capable of fitting a range of chest sizes, for example, between 30 inches and 52 inches, which is known as universal sizing. It is of buoyant material, which is commercially available for use in personal floatation devices and which generally is known as closed cell foam material. The device is intended to keep a person's head out of the water and serve as a U.S. Coast Guard Type II personal floatation device. There has long been a need in the field for a floatation device capable of being worn with comfort for a wide range of chest sizes while at the same time meeting the requirements of such Type II devices. This invention is of a structure which can be worn for extended lengths of time and which provides and meets the requirements of Type II personal floatation devices. Generally, the invention is composed of a front and back panel which encircle the body of a wearer in use and which are connected by a shoulder panel with an opening through which the head of a user is passed with the device being strapped about the body and wherein a head support panel is swingably connected to the back panel to support the head of a wearer when in use in water.

OBJECTS OF THIS INVENTION

It is a general object of this invention to provide a personal floatation device which meets the requirements of Type II of the U.S. Coast Guard, a Type intended to keep an unconscious wearer's head out of the water, which is relatively simple to construct, and which is comfortable in use, albeit for an extended length of time, and which can be universal in sizing for accommodating a wide range of chest sizes, e.g., 30 to 52 inches.

In accordance with this general object, this invention will now be described on reference to the accompanying drawings in which:

DESCRIPTION OF THE PREFERRED EMBODIMENT

Figure 4:
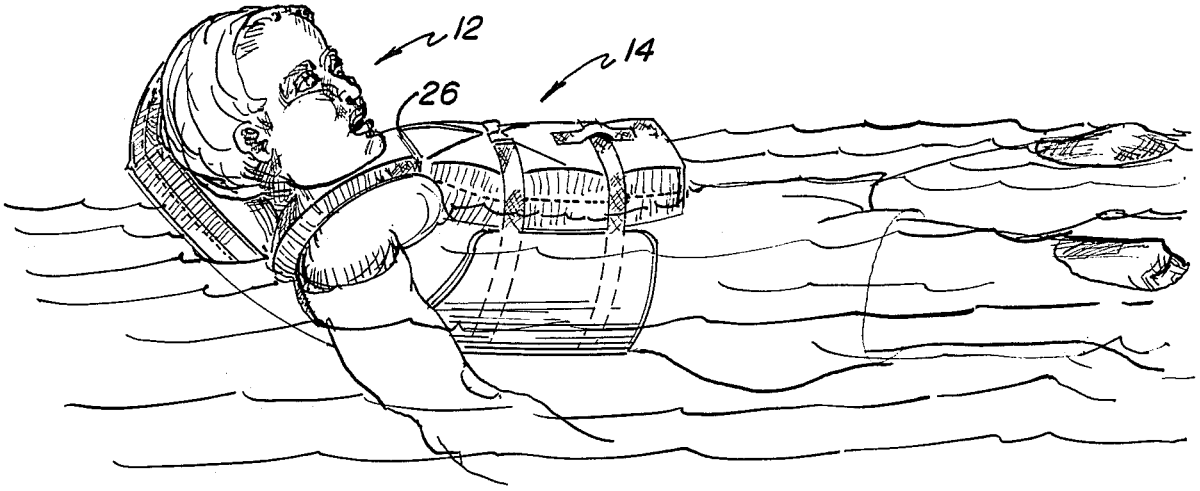
FIG. 4 illustrates the personal floatation device in use.
Figure 6:
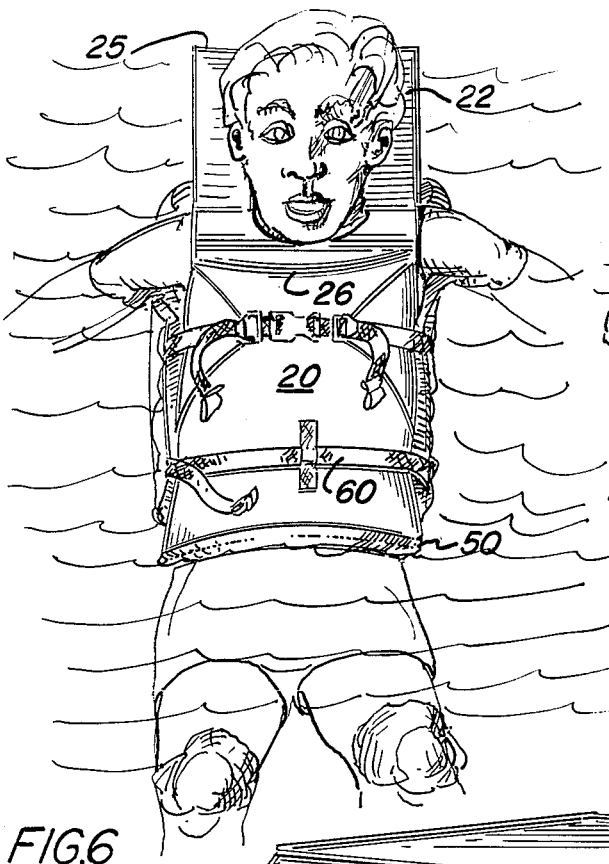
FIG. 6 and FIG. 7 illustrate the personal floatation device in use on a wearer.
Figure 7:
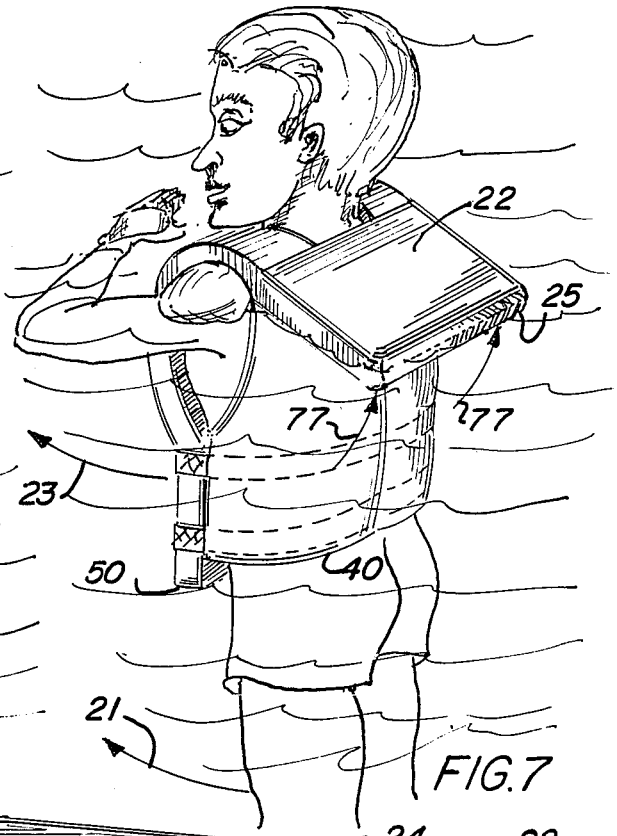
Figure 8:
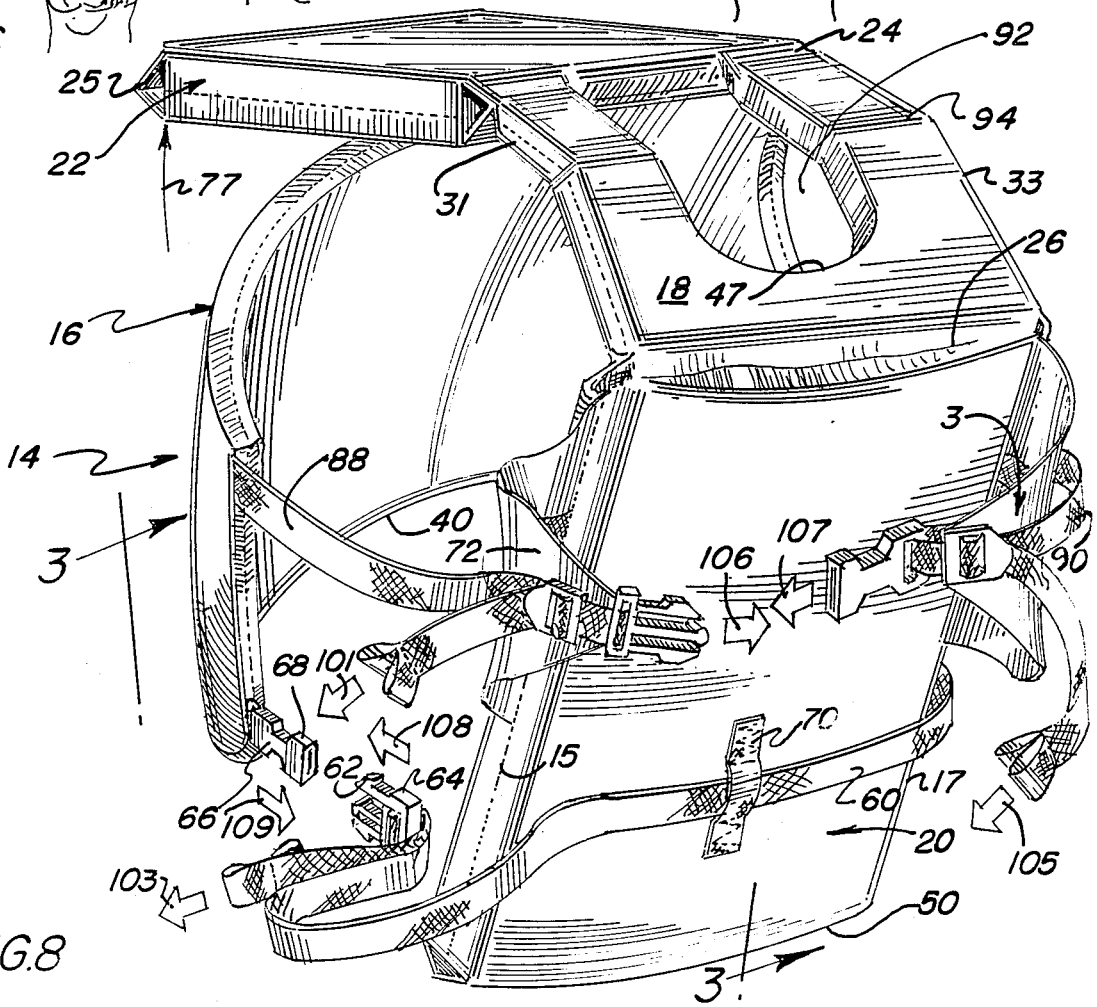
FIG. 8 is a perspective view illustrating the personal floatation device of the instant invention.

Referring to the drawings and particularly to FIG. 8, it is seen that the personal floatation device 14 is composed of a front panel 20 to overlay the chest of a user, a back panel 16 to overlay the back of a wearer, a shoulder panel 18 with an opening through it to rest on the shoulders of a wearer and a swingable head support panel 22 to support the head of a wearer, see FIGS. 4, 6 and 7. It is seen that when inclined in the water, see FIGS. 4 and 6, that is with the lower torso of the user floating, the head support panel supports the head out of the water while, as seen in FIG. 7, if the lower torso is generally vertical, the shoulder panel at the opening supports the chin of the wearer keeping it elevated.

Figure 1:
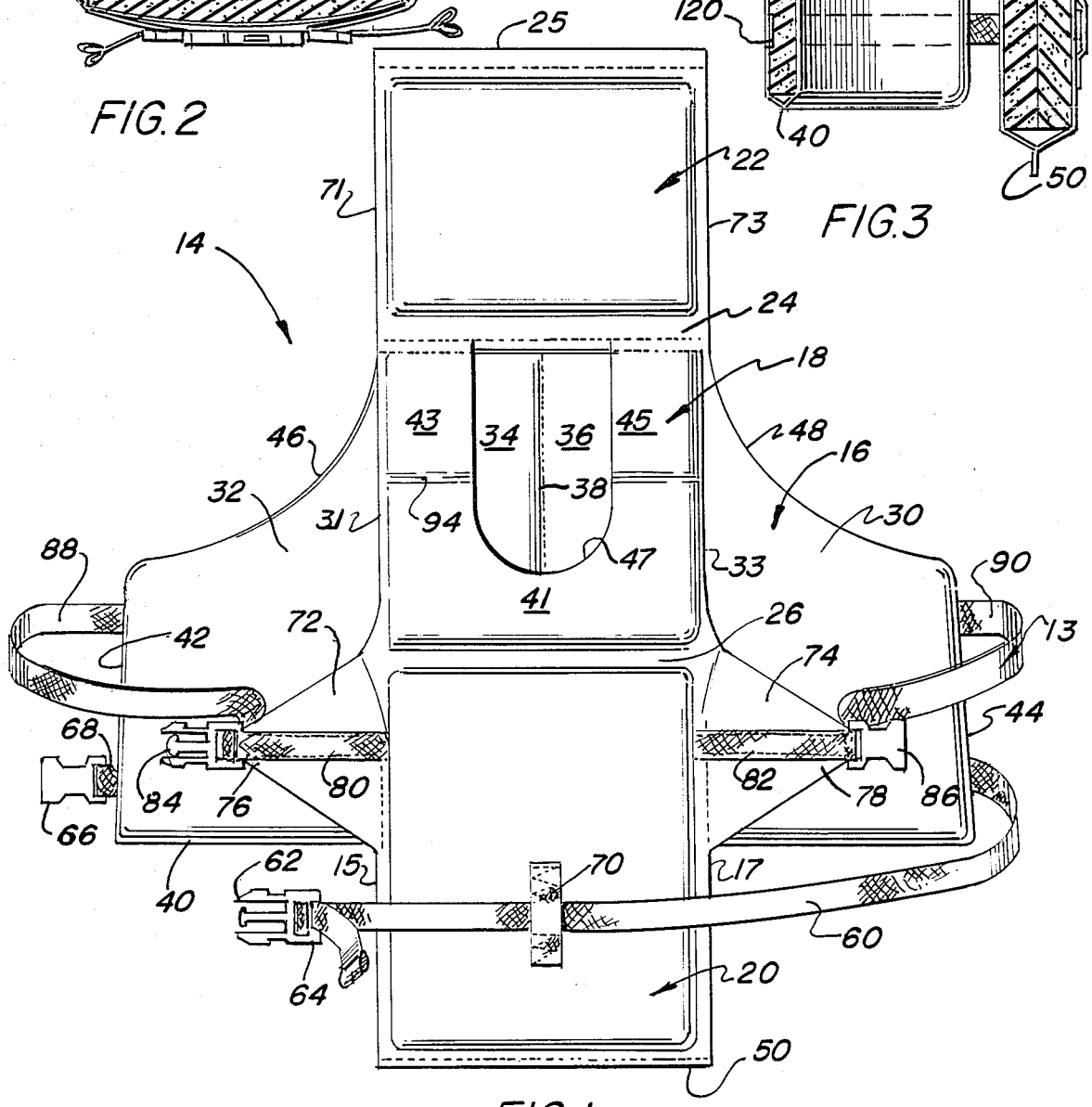
FIG. 1 is an elevation view of the personal floatation device when not in use as seen from the front.
Figure 5:
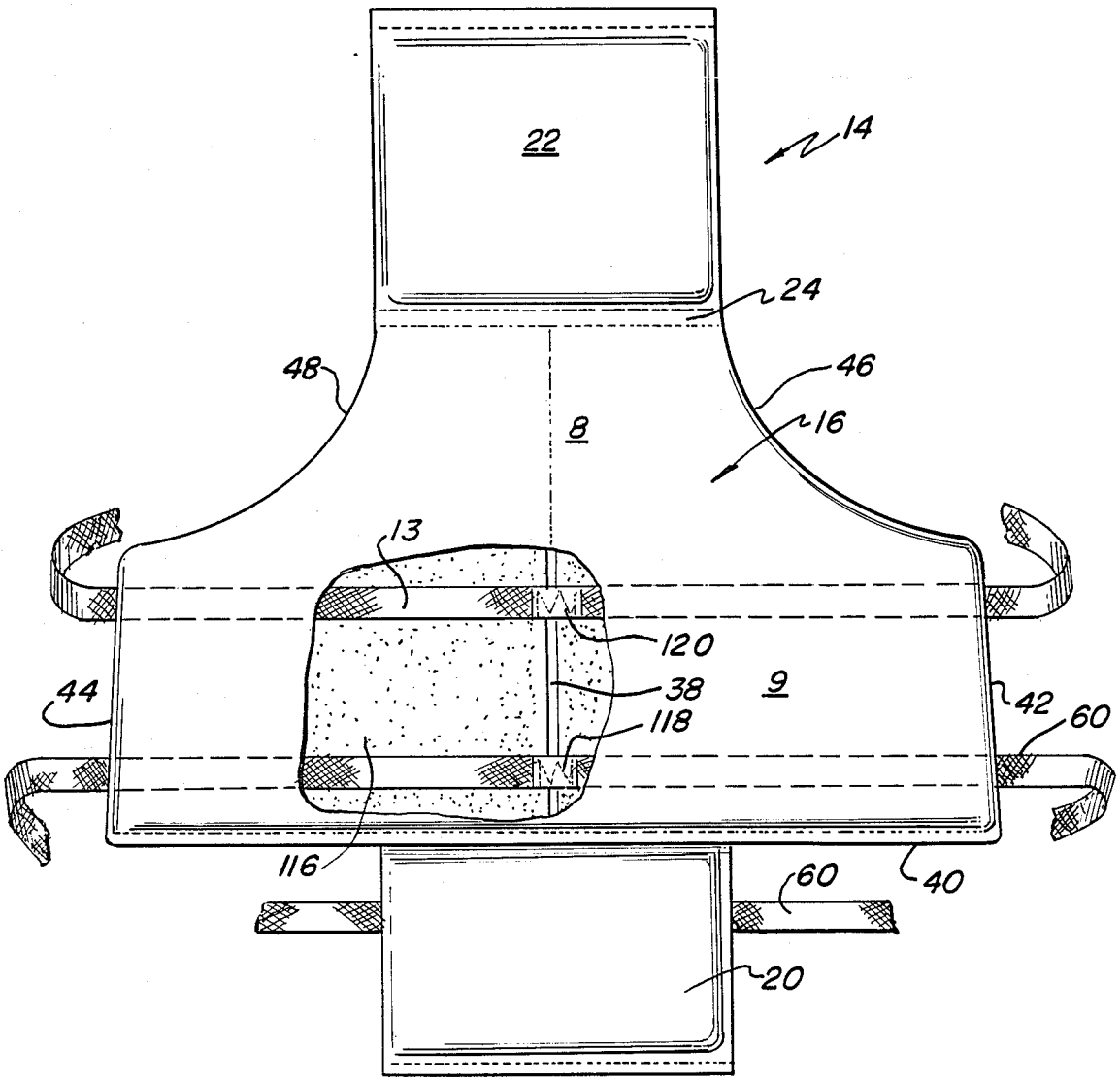
FIG. 5 is a partially broken away rear view of the personal floatation device when not in use on a wearer.

When not in use on a wearer, the personal floatation device generally assumes the configuration seen in FIG. 1, which is a view as seen from the front, note the front panel 20 and the inside surface of the back panel 16, the shoulder panel with its opening extending from the upper edge 26 of the front panel to the upper edge 24 of the back panel and the swingable head support panel 22. The same panels are seen from the back in FIG. 5, note, at the top of FIG. 5, the head support panel, the outer surface of the back panel, and the depending portion of the front panel 20. In the following paragraphs reference will be made in seriatim to each of the panels of the personal floatation device 14.

The back panel is a vertically symmetrical member in the preferred embodiment sized to overlay the back of a wearer. It has an inner surface and an outer surface and may be considered as having an upper zone 8 which is smaller than the lower zone 9. Generally the back panel has a lower edge 40 which is sized to extend across the back of a weare at about the bottom of the rib cage and about the sides of the wearer extending toward the front to a pair of side edges 42 and 44 each extending toward an upper edge 24 which is somewhat shorter than the lower edge 40 by reason of the fact that along the sides of the back panel extending from the lower back panel zone 9 and along the sides of the upper back panel zone 8, the side edges are curved inwardly and toward the upper edge 24 as at 46 and 48 defining fair curves which in use are under the armpits of a user.

In a preferred embodiment, the back panel is composed of two portions 34 and 36 which are interconnected at a hinge line 38 for ease in conforming to the curvature of the back. While the nomenclature hinge means is provided, this is intended to include that the back panel is bendable or pliable for the purpose specified, namely, so that the outer portions of the back panel 30 and 32 may conform to and wrap around the sides of a wearer.

Figure 2:
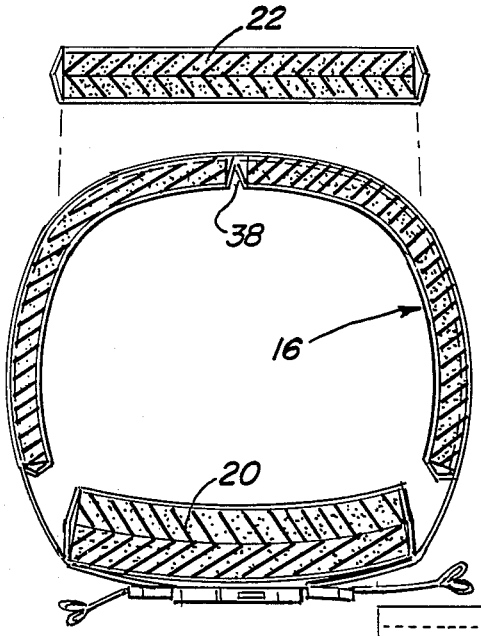
FIG. 2 is a view in cross-section of the personal floatation device when on a wearer; it is taken on the plane indicated by the arrowed line 2—2 of FIG. 3.
Figure 3:
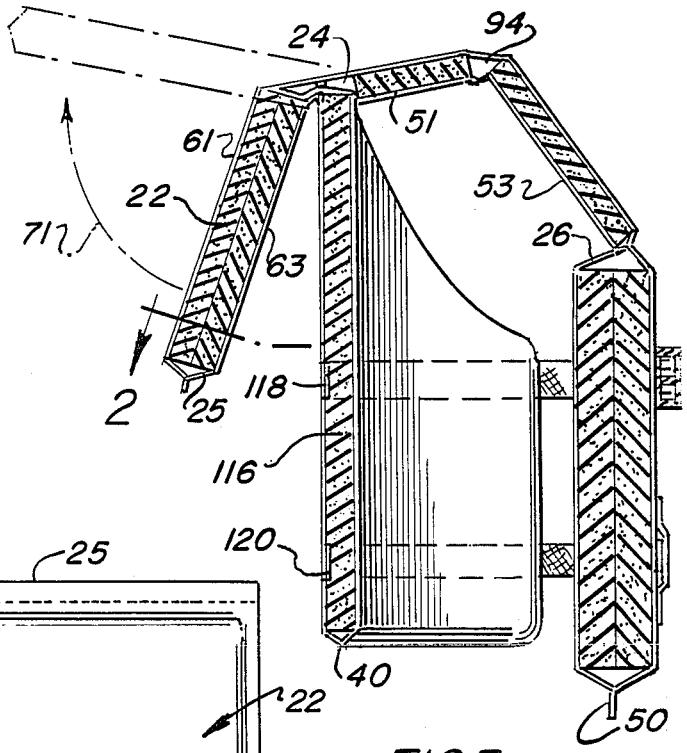
FIG. 3 is a view in cross-section of the personal floatation device on a wearer; it is taken on the plane indicated by the arrowed line 3—3 in FIG. 8.

The front panel 20, which is seen in FIG. 8 and FIG. 1, for example, is sized to overlay the chest of a wearer and it has an inner and an outer surface as well as a lower edge 50 which in use is generally colinear with the bottom edge 40 of the back panel. In other words, the lower edge of the front panel extends downwardly to roughly the same extent as does the back panel when about a user's body and preferably, a little further as shown in FIGS. 3 and 4 for example. It is seen that the upper edge 26 of the front panel in use extends across the upper portion of the chest of a wearer below the shoulders. The front panel has side edges 15 and 17 each extending between the upper and lower edges of the front panel 26 and 50 respectively and generally overla the breasts of a wearer when in use. Preferably, the front panel is about twice the thickness of the other panels to provide more buoyancy so that a person in the water tends to assume the attitude shown in FIG. 6 tending to exert a force as shown by the arrowed lines 21 and 23 in FIG. 7.

As best seen in FIG. 8 and FIG. 1, the shoulder panel 18 connects the front and back panel together. The shoulder panel 18 has an opening 92 sized for passage of the head of a wearer. The shoulder panel has a front edge generally at 26 and a rear edge generally at 24 and side edges 31 and 33. The front edge of the shoulder panel and the upper edge of the front panel are connected together at a zone which is bendable. To this end, a flap zone comprising a hinge means may be provided extending between the side edges of the shoulder panel and the side edges of the front panel. Similarly, a second flap zone 24 also comprising a bendable zone or what may be termed a hinge means that extends between the rear edge of the shoulder panel and the upper edge of the back panel between the side edges of the back panel and the shoulder panel. These flap zones 24 and 26 it will be appreciated can be formed in various ways so that the front and back panel overlay the chest and back of a wearer and the shoulder panel on opposite sides of the head opening 92 conform to the curvature of the upper surface of the shoulders of a wearer. For example, the shoulder panel may be U-shaped as shown defining a base portion 41 and leg portions 43 and 45 with the edge of the base 47 at the opening tending to bear against the wearer beneath the chin of a wearer to hold the head out of the water when in use. As shown at 94, each of the leg portions 43 and 45 of the shoulder panels may be bendable intermediate their length, that is, with each leg portion comprising two sub-portions 51 and 53 which are connected together as at 94, see FIG. 3.

The device 14 for a wearer 12 also includes a swingable head support panel 22 which has an upper surface and a lower surface, see FIG. 3, and a proximal edge, see 24, and swingable distal or terminal edge 25 with a pair of spaced side edges 71 and 73 extending between the proximal and terminal edges 24 and 25. As shown best in FIG. 8, the swingable head support panel is connected to the second flap zone 24, that is the zone interconnecting the rear edge of the shoulder panel and the upper edge of the back panel. As shown by the arrowed lines 77, see FIGS. 3, 7 and 8, buoyant forces tend to cause the head support panel to cause the upper surface of it to support the back of the head of a wearer when the lower torso of a wearer floats upwardly in the direction of the arrowed lines 21 and 23 in FIG. 7. Thus it is seen that the swingable head support panel is connected to the back panel at about its juncture with the shoulder panel rear edge and that it is swingable between a first position with the lower surface 63 adjacent the outer surface of the back panel, see FIG. 3 and a head supporting position where, in use, the upper surface 61 supports the head of a wearer and the outer swinging or terminal edge 25 is generally parallel to the upper edge of the back panel and extends across the back of the head of a wearer.

The means to connect the panels about the body of a wearer as a personal floatation device will now be described. Generally, these means comprise a girth strap and a strap means about the chest and upper back of the wearer.

Referring to the girth strap generally indicated by the numeral 60, it is seen to have a first end zone 64 and a second end zone 66 with an intermediate zone therebetween. The girth strap 60 is sized to extend about the girth of a wearer as well as the back and front panels. Means are provided to maintain it adjacent the lower edge 50 and 40 of the front and back panels respectively. In the preferred embodiment, means are provided to secure the girth strap to the lower zone 9 of the back panel adjacent the lower edge 40, see FIG. 9. This may include stitching the girth strap as at 118 to the back panel in the central portion of the lower zone 9 of the back panel 16 as well a at the side edges 42 and 44 of the back panel. In the preferred embodiment, the second end zone 66 of the girth strap is provided with a fastener portion 68 while the other end of the girth strap is provided with a mutually interengageable fastener member 62. In the preferred embodiment, the second end zone is if a length sufficient to extend from the side edge 44 of the back panel across the front panel being threaded through a loop 70 secured to the front panel so that the girth strap cannot ride upwardly being secured adjacent the lower edges 40 and 50 of the back panel and front panel respectively by the means 118 and 70 respectively.

The chest strap means will now be referred to. It includes a strap 3, see FIG. 5, secured to the back panel in spaced relation from the girth strap means as at 120 and preferably, also, at the side edges 42 and 44 of the back panel with the chest panel having a pair of extending lengths 88 and 90, see FIG. 1. Turning now to the fastener means for securing the chest strap means and the girth strap, any suitable means may be provided. However, see FIG. 1, it is preferred that these means include a male portion 84 sized to be received in a socket of a mating female means 86 in a snap-type connector commercially available. Preferably, the chest strap means and the girth strap are of webbing material and the connectors include adjustment means so that the length of the chest and back strap means and the girth strap may be varied somewhat. To this end, see FIG. 8, the chest and upper back strap means and the girth strap are folded back upon themselves through the connector so that forces exerted on the arrow 101 and 103 tighten, that is, shorten the length of the associated strap. See also 105. The fastener means are connected together as indicated by the arrowed lines 106, 107 and 108 and 109. In the preferred embodiment shown, and as best seen in FIG. 1 and FIG. 8, the front panel 20 may include side flaps 72 and 74 which are generally pliable or flexible and of triangular shape with the base of each flap being connected to one of the side edges 15 and 17 and with the flap edges converging outwardly to the apex zone as at 76 and 78. In the preferred embodiment, the chest and upper back strap means includes a length of strap of webbing material secured to the inner surface of the front panel and extending outwardly centrally and along the altitude of each triangular flap so that, as shown in FIG. 8, when connected together the connection is constrained to a location on the front panel outer surface which is below the upper surface of the front panel. It is thus seen that these triangular shaped flaps when the chest and upper back strap means are connected together secure the connector in a generally stationary position preventing it from moving in and up or down or lateral direction. This is helpful in preventing the device from bunching up in its buoyant position. Also, when the device is worn, but not yet buckled, these V-shaped triangular shaped flaps prevent entanglement and twisting of the straps and, also, when in the slack position, after one's head has been inserted through the opening, presents to a user a clear indication of how the device is to be fastened about the body. In use, it is seen, also, that when the headrest 22 is swingably moved upwardly, the forces exerted by the buoyancy of the water tend to cause the neck opening of the device to contract positioning the chin of the wearer on the base portion of the shoulder panel supporting it.

While this invention has been shown and described in a preferred embodiment, it is recognized that the panels can be connected together in various ways to provide for the fitting of it to the body of a wearer generally in the manner described and, accordingly, the use of the term hinge means for flexible connections of the panels should not be construed so as to restrict the claims. Conventional suitable buoyant materials well known in the art are utilized in making the panels and, preferably, each of the panels is enveloped in strong, durable canvas material which may be nylon which is stitched together to complete the panel constructions.

What is claimed is:

1. A personal floatation device comprising:

A. a vertically symmetrical back panel sized to overlay the back of a wearer and having an inner surface and an outer surface and having an upper zone and a lower zone, said back panel having, (a) a lower edge sized to extend across the back of a wearer at about the bottom of the rib cage and about the sides of a wearer toward the front of the wearer, (b) an upper edge shorter than said lower edge sized to extend across the shoulders of a wearer at the neck of a wearer, and (c) a pair of side edges on the lower portion each extending generally upwardly vertically from the lower edge to the upper port.on and each converging inwardly and upwardly defining a fair curve extending to the upper edge from the side edges of the lower zone, B. a front panel sized to overlay the chest of a wearer and having an inner surface and an outer surface and having, (a) a lower edge which in use is generally parallel to the bottom edge of the back panel and extends slightly below the level of the bottom edge of the back panel, (b) an upper edge which in use extends across the upper portion of the chest of a wearer below the shoulders, and (c) a pair of spaced side edges each extending between the upper and lower edges of the front panel, C. a shoulder panel having an opening for passage of the head of a wearer and having a front edge, rear edge and side edges, D. a first zone between the front edge of the shoulder panel and the upper edge of the front panel comprising a bendable zone extending between the side edges of the shoulder panel and the side edges of the front panel, and a second zone between the upper edge of the back panel and the back edge of the shoulder panel comprising a bendable zone extending between the side edges of the shoulder panel and side edges of the back panel, E. means connecting said panels together at said first and second zones, F. a girth strap having a first end zone and a second end zone and an intermediate zone, G. said girth strap being sized to extend about the girth of a wearer and the back and front panels adjacent the lower edges of said front and back panels, H. means securing the intermediate zone of the girth strap to the lower zone of the back panel and adjacent the lower edge of said back panel with said first end zone extending from one side edge of said back panel, and wherein said second end zone extends from the other side edge of said back panel, I. said first and second end zones each having an end, and mutually interengageable releasable fastening means on the end of the first end zone and second end zone, J. means on the front panel to maintain the girth strap in position adjacent the lower edge of the front panel, K. chest and upper back strap means sized to extend around the chest of a weare and the back and front panel adjacent the upper edge of the front panel and across the lower zone of the back panel between the girth strap and the upper edge of the back panel, L. means securing said back strap means to said back panel, and M. fastener means on the back strap means for hooked-up engagement about the body of a wearer.

2. The device as set forth in claim 1 including, a head support panel having an upper surface and a lower surface and a proximal edge and a distal edge and a pair of spaced side edges between the proximal and distal edge, means connecting the proximal edge of the head support panel in generally parallel relation to the upper edge of the back panel and to the second zone and said head support panel being swingable between (a) a first position with the lower surface adjacent the outer surface of the back panel and (b) a head supporting position where, in use, the upper surface supports the head of a wearer and the distal edge is generally parallel to the uppe edge of the back panel and extends across the back of the head of a wearer.

3. The floatation device as set forth in claim 1 wherein the second end zone is of a length to extend across the front panel to said first end zone.

4. The floatation device as set forth in claim 1 wherein said back strap means includes a central portion and means securing said central portion to said back panel and defining a first extending length and an opposite second extending length, and said device includes means to secure the extending lengths to the front panel.

5. The floatation device as set forth in claim 4 wherein adjustment means are provided to vary the length of said extending lengths.

6. The floatation device as set forth in claim 4 wherein said means to secure the extending lengths comprise a pair of triangularly shaped flaps included on said front panel, each having a base secured to one of the side edges of the front panel and each flap having side edges that converge toward one another to an apex zone and the distance between the apex zon and the base of each flap being somewhat less than one-half the distance between the side edges of said front panel and means captivating one of the extending lengths to each of the apex zones.

7. The floatation device as set forth in claim 1 including means to adjust the length of the back strap means and girth strap.

8. The floatation device as set forth in claim 6 wherein loop means are affixed to the outer surface of the front panel adjacent the lower edge and said second girth strap end zone is threaded through said loop means to maintain it in a predetermined position between the upper and lower edges of the front panel.

9. The floatation device as set forth in claim 1 wherein the shoulder panel is generally U-shaped defining a base portion comprising a chin support and a pair of legs defining shoulder straps extending to and defining the rear edge of said shoulder panel.

10. The floatation device as set forth in claim 9 wherein said shoulder straps are bendable to conform to each of the shoulders of a wearer.

11. The floatation device as set forth in claim 1 wherein the back panel is bendable at a zone extending between the upper edge and the lower edge of the back panel between the back panel side edges to permit conforming of the back panel about the back of a wearer.

* * * * *